US007761945B2

(12) United States Patent
Butler

(10) Patent No.: US 7,761,945 B2
(45) Date of Patent: Jul. 27, 2010

(54) APPARATUS AND METHODS FOR PREVENTING PRESSURE ULCERS IN BEDFAST PATIENTS

(75) Inventor: Glenn Butler, Tarrytown, NY (US)

(73) Assignee: Life Support Technologies, Inc., Tarrytown, NY (US)

( * ) Notice: Subject to any disclaimer, the term of this patent is extended or adjusted under 35 U.S.C. 154(b) by 38 days.

(21) Appl. No.: 11/140,768

(22) Filed: May 31, 2005

(65) Prior Publication Data

US 2005/0262639 A1 Dec. 1, 2005

Related U.S. Application Data

(60) Provisional application No. 60/575,298, filed on May 28, 2004.

(51) Int. Cl.
*A27C 27/10* (2006.01)

(52) U.S. Cl. ..... 5/713; 5/710

(58) Field of Classification Search ..... 5/710–714
See application file for complete search history.

(56) References Cited

U.S. PATENT DOCUMENTS

| | | | | |
|---|---|---|---|---|
| 3,394,415 | A | 7/1968 | Parker | |
| 3,670,460 | A | 6/1972 | Oldfield et al. | |
| 3,674,019 | A | 7/1972 | Grant | |
| 3,678,520 | A | 7/1972 | Evans | |
| 3,705,576 | A | 12/1972 | Roth | |
| 3,745,998 | A | 7/1973 | Rose | |
| 3,825,320 | A | 7/1974 | Redfern | |
| 3,877,427 | A * | 4/1975 | Alexeev et al. | 128/202.13 |
| 3,941,121 | A | 3/1976 | Olinger et al. | |
| 4,127,319 | A | 11/1978 | Forney, Jr. et al. | |
| 4,197,837 | A | 4/1980 | Tringali et al. | |
| 4,267,611 | A | 5/1981 | Agulnick | |
| 4,336,809 | A | 6/1982 | Clark | |

(Continued)

FOREIGN PATENT DOCUMENTS

| | | |
|---|---|---|
| CN | 2287698 | 8/1998 |

(Continued)

OTHER PUBLICATIONS

Dec. 29, 2009 Response to Final Office Action of U.S. Appl. No. 12/115,371 mailed Oct. 29, 2009.

(Continued)

*Primary Examiner*—Fredrick Conley
(74) *Attorney, Agent, or Firm*—Dugan & Dugan, PC

(57) ABSTRACT

A mattress and temperature control system for preventing pressure ulcers is provided. The mattress and temperature control system may include at least two chambers that may be alternately pressurized to each independently support a patient's body reclined on the mattress at different times. In some embodiments, the chambers may be implemented as an inflatable tubing system including at least two inflatable tubing circuits each having inflatable tubes disposed adjacent one another in an alternating manner. The tubes may be inflated with liquid or gas fluids. The system may include a tube pressurizing control device for controlling the inflation of the at least two inflatable tubing circuits in an alternating manner. A gas permeable membrane may encapsulate the inflatable tubing system and may be used to move air between the patient and the mattress for cooling and to remove any moisture.

30 Claims, 7 Drawing Sheets

U.S. PATENT DOCUMENTS 4,444,516 A 4/1984 Dostoomian et al.
4,469,399 A 9/1984 Cowen et al.
4,544,233 A 10/1985 Iwamoto et al.
4,614,190 A 9/1986 Stanco et al.
4,653,130 A 3/1987 Senoue et al.
4,682,846 A 7/1987 Cowen
4,683,523 A 7/1987 Olsson et al.
4,687,980 A 8/1987 Phillips et al.
4,822,335 A 4/1989 Kawai et al.
4,825,486 A 5/1989 Kimura et al.
4,859,021 A 8/1989 Wall
4,886,831 A 12/1989 Morcos et al.
4,889,129 A 12/1989 Dougherty et al.
4,891,640 A 1/1990 Ip
4,930,504 A 6/1990 Diamantopoulos et al.
4,932,934 A 6/1990 Dougherty et al.
4,947,500 A 8/1990 Seiler
4,957,481 A 9/1990 Gatenby
4,977,361 A 12/1990 Phillips et al.
5,012,609 A 5/1991 Ignatius et al.
5,026,367 A 6/1991 Leckrone et al.
5,041,108 A 8/1991 Fox et al.
5,053,033 A 10/1991 Clarke
5,054,867 A 10/1991 Wagnieres et al.
5,060,644 A 10/1991 Loori
5,098,426 A 3/1992 Sklar et al.
5,103,518 A 4/1992 Gilroy et al.
5,109,560 A 5/1992 Uetake
5,109,561 A 5/1992 Schild
5,146,917 A 9/1992 Wagnieres et al.
5,151,096 A 9/1992 Khoury
5,151,967 A 9/1992 Ebinuma
5,163,898 A 11/1992 Morcos et al.
5,243,723 A 9/1993 Cotner et al.
5,253,321 A 10/1993 Long et al.
5,257,970 A 11/1993 Dougherty
5,267,364 A 12/1993 Volk
5,278,432 A 1/1994 Ignatius et al.
5,298,018 A 3/1994 Narciso
5,401,270 A 3/1995 Muller et al.
5,413,587 A 5/1995 Hochstein
5,445,608 A 8/1995 Chen et al.
5,454,794 A 10/1995 Narciso et al.
5,466,234 A 11/1995 Loeb et al.
5,503,143 A 4/1996 Marion et al.
5,562,656 A 10/1996 Sumiya
5,573,531 A 11/1996 Gregory
5,582,574 A 12/1996 Cramer
5,584,085 A * 12/1996 Banko ..... 5/710
5,592,706 A 1/1997 Pearce
5,623,736 A 4/1997 Soltani et al.
5,645,550 A 7/1997 Hohla
5,649,972 A 7/1997 Hochstein
5,651,783 A 7/1997 Reynard
5,660,461 A 8/1997 Ignatius et al.
5,685,036 A 11/1997 Kopfstein et al.
5,698,866 A 12/1997 Doiron et al.
5,725,522 A 3/1998 Sinofsky
5,728,090 A 3/1998 Martin et al.
5,762,867 A 6/1998 D'Silva
5,794,289 A 8/1998 Wortman et al.
5,860,967 A 1/1999 Zavislan et al.
5,865,832 A 2/1999 Knopp et al.
5,873,137 A * 2/1999 Yavets-Chen ..... 5/713
5,901,393 A 5/1999 Pepe et al.
5,902,328 A 5/1999 LaFontaine et al.
5,918,336 A 7/1999 Lee et al.
5,938,657 A 8/1999 Assa et al.
5,944,748 A 8/1999 Mager et al.
5,963,997 A * 10/1999 Hagopian ..... 5/654
5,983,428 A 11/1999 Hannagan
5,989,245 A 11/1999 Prescott
6,011,563 A 1/2000 Fournier et al.
6,019,482 A 2/2000 Everett
6,048,359 A 4/2000 Biel
6,062,215 A * 5/2000 Leininger et al. ..... 128/202.12
6,073,289 A 6/2000 Bolden et al.
6,099,522 A 8/2000 Knopp et al.
6,152,919 A 11/2000 Hakky
6,197,099 B1 3/2001 Pearce
6,203,540 B1 3/2001 Weber
6,203,542 B1 3/2001 Ellsberry et al.
6,206,654 B1 3/2001 Cassidy
6,210,425 B1 4/2001 Chen
6,221,095 B1 4/2001 Van Zuylen et al.
6,241,697 B1 6/2001 Augustine
6,290,713 B1 9/2001 Russell
6,308,353 B1 10/2001 Van Steenburg
6,326,550 B1 12/2001 Dyer et al.
6,334,069 B1 12/2001 George et al.
6,344,050 B1 2/2002 Chen
6,353,763 B1 3/2002 George et al.
6,353,948 B1 3/2002 Bolden et al.
6,374,031 B1 4/2002 Nelms, Jr.
6,402,681 B1 6/2002 McDonough et al.
6,443,978 B1 9/2002 Zharov
6,484,716 B1 11/2002 Leininger et al.
6,497,231 B1 12/2002 White
6,511,414 B1 1/2003 Hamsund
6,605,082 B2 8/2003 Hareyama et al.
6,618,620 B1 9/2003 Freundlich et al.
6,641,578 B2 11/2003 Mukai
6,669,684 B2 12/2003 Nakamura
6,676,654 B1 1/2004 Balle-Petersen et al.
6,697,664 B2 2/2004 Kienzle, III et al.
6,789,284 B2 * 9/2004 Kemp ..... 5/713
6,979,328 B2 12/2005 Baerveldt et al.
7,001,413 B2 2/2006 Butler
7,201,766 B2 4/2007 Butler
7,270,593 B2 9/2007 Klein et al.
7,367,342 B2 5/2008 Butler
7,386,339 B2 6/2008 Strommer et al.
2002/0026180 A1 2/2002 Nakamura
2002/0120312 A1 8/2002 Ignatius et al.
2002/0173833 A1 11/2002 Korman et al.
2003/0004499 A1 1/2003 McDaniel
2003/0159700 A1 8/2003 Laufer et al.
2004/0068305 A1 4/2004 Bansal et al.
2004/0098069 A1 5/2004 Clement et al.
2004/0158300 A1 8/2004 Gardiner
2004/0215176 A1 10/2004 Bahk
2004/0261796 A1 12/2004 Butler
2006/0111761 A1 5/2006 Butler
2007/0073365 A1 3/2007 Butler
2008/0281383 A1 11/2008 Butler

FOREIGN PATENT DOCUMENTS

DE 3837248 5/1990
EP 0237046 B1 9/1987
GB 2164137 3/1986
IT 1266185 B1 12/1996
WO WO 86/02244 4/1986
WO WO 9920988 4/1999
WO WO 01/89348 A3 11/2001
WO WO 02/39558 A2 5/2002

OTHER PUBLICATIONS

Notice of Abandonment of U.S. Appl. No. 11/329,513 mailed Dec. 29, 2009.
Advisory Action of U.S. Appl. No. 12/115,371 mailed Feb. 3, 2010.
Feb. 15, 2010 Response to Final Office Action of U.S. Appl. No. 10/880,676 mailed Nov. 13, 2009.
Office Action of U.S. Appl. No. 10/613,608 mailed Jun. 7, 2004.

Sep. 7, 2004 Response to Office Action of U.S. Appl. No. 10/613,608 mailed Jun. 7, 2004.
Office Action of U.S. Appl. No. 10/613,608 mailed Nov. 3, 2004.
Mar. 3, 2005 Response to Office Action of U.S. Appl. No. 10/613,608 mailed Nov. 3, 2004.
Final Office Action of U.S. Appl. No. 10/613,608 mailed Mar. 18, 2005.
Jul. 18, 2005 Response to Final Office Action of U.S. Appl. No. 10/613,608 mailed Mar. 18, 2005.
Advisory Action of U.S. Appl. No. 10/613,608 mailed Aug. 4, 2005.
Aug. 18, 2005 Response to Final Office Action of U.S. Appl. No. 10/613,608 mailed Mar. 18, 2005.
Notice of Allowance of U.S. Appl. No. 10/613,608 mailed Sep. 6, 2005.
Office Action of U.S. Appl. No. 11/329,513 mailed Jul. 14, 2008.
Nov. 17, 2008 Response to Office Action of U.S. Appl. No. 11/329,513 mailed Jul. 14, 2008.
Final Office Action of U.S. Appl. No. 11/329,513 mailed Jun. 9, 2009.
Office Action of U.S. Appl. No. 10/726,028 mailed Dec. 29, 2006.
Mar. 28, 2007 Response to Office Action of U.S. Appl. No. 10/726,028 mailed Dec. 29, 2006.
Final Office Action of U.S. Appl. No. 10/726,028 mailed Jul. 13, 2007.
Oct. 15, 2007 Response to Final Office Action of U.S. Appl. No. 10/726,028 mailed Jul. 13, 2007.
Notice of Allowance of U.S. Appl. No. 10/726,028 mailed Dec. 26, 2007.
Office Action of U.S. Appl. No. 12/115,371 mailed Apr. 1, 2009.
Jul. 1, 2009 Response to Office Action of U.S. Appl. No. 12/115,371 mailed Apr. 1, 2009.
Final Office Action of U.S. Appl. No. 12/115,371 mailed Oct. 29, 2009.
Office Action of U.S. Appl. No. 10/726,040 mailed Aug. 9, 2005.
Nov. 10, 2005 Response to Office Action of U.S. Appl. No. 10/726,040 mailed Aug. 9, 2005.
Office Action of U.S. Appl. No. 10/726,040 mailed Jan. 4, 2006.
Apr. 4, 2006 Response to Office Action of U.S. Appl. No. 10/726,040 mailed Jan. 4, 2006.
Final Office Action of U.S. Appl. No. 10/726,040 mailed May 16, 2006.
Sep. 18, 2006 Response to Final Office Action of U.S. Appl. No. 10/726,040 mailed May 16, 2006.
Advisory Action of U.S. Appl. No. 10/726,040 mailed Sep. 27, 2006.
Nov. 16, 2006 Response to Final Office Action of U.S. Appl. No. 10/726,040 mailed May 16, 2006.
Notice of Allowance of U.S. Appl. No. 10/726,040 mailed Nov. 29, 2006.
Office Action of U.S. Appl. No. 11/560,685 mailed Feb. 13, 2009.
Apr. 16, 2009 Response to Office Action of U.S. Appl. No. 11/560,685 mailed Feb. 13, 2009.
Office Action of U.S. Appl. No. 11/560,685 mailed Aug. 19, 2009.
Nov. 6, 2009 Response to Office Action of U.S. Appl. No. 11/560,685 mailed Aug. 19, 2009.
Office Action of U.S. Appl. No. 10/880,676 mailed Apr. 2, 2009.
Jun. 17, 2009 Response to Office Action of U.S. Appl. No. 10/880,676 mailed Apr. 2, 2009.
Whelan et al., "NASA Light Emitting Diode Medical Applications From Deep Space to Deep Sea," Space Technology and Applications International Forum—2001, American Institute of Physics, pp. 35-45 (2001).
Final Office Action of U.S. Appl. No. 10/880,676 mailed Nov. 13, 2009.
Advisory Action of U.S. Appl. No. 10/880,676 mailed Mar. 12, 2010.
Notice of Allowance of U.S. Appl. No. 11/560,685 mailed Mar. 22, 2010.
Office Action of U.S. Appl. No. 10/880,676 mailed May 11, 2010.

* cited by examiner

APPARATUS AND METHODS FOR PREVENTING PRESSURE ULCERS IN BEDFAST PATIENTS

The present invention claims priority to U.S. Provisional Patent Application No. 60/575,298, filed May 28, 2004 and entitled "Apparatus And Method For Providing A Mattress And Temperature Control System For Preventing Pressure Ulcers," which is hereby incorporated herein for all purposes.

FIELD OF THE INVENTION

The present invention relates to apparatus and methods for providing a mattress system for preventing pressure ulcers and, in particular, to apparatus and methods for providing a mattress system for preventing pressure ulcers during hyperbaric oxygen therapy, surgical and/or medical procedures.

BACKGROUND OF THE INVENTION

Pressure ulcers, e.g., decubitus ulcers, are known to develop as a result of an inactive metabolic and inflammatory process which begins when sufficient pressure is applied to the skin and underlying tissues to overcome normal arterial and/or capillary blood pressure and can result in tissue anoxia and cellular death. In healthy individuals, any discomfort associated with any prolonged tissue point pressure anoxia can be relieved by movement of the affected area. Unfortunately, however, individuals and patients suffering from conditions such as acute peripheral neuropathy, paraplegia, dementia, or other debilitating conditions, who are unable to sense pain or discomfort and unable to effect movement to alleviate such, can eventually develop ulcers or ulcerations which can be difficult to manage in a clinical environment due to an individual's or patient's position. The individual or patient may be confined to a posterior position or location, exposed to various contaminants, experience wound drainage, or require frequent dressing changes, each of which can contribute to the formation and exacerbation of ulcers and ulcerations.

Certain treatments have been found to be beneficial in treating individuals and patients afflicted with pressure ulcers. Individuals and patients, for example, have been found to benefit from ulcer pressure off-loading, frequent rotation, wound management regimens, dressing changes, treatment with antibiotics, and Hyperbaric Oxygen Therapy ("HBO"). Whenever possible, ulcer patients are placed on low-pressure beds to reduce point pressures and promote healing. While Hyperbaric Oxygen Therapy has been found to be of particular benefit to patients suffering from pressure ulcers, such treatments typically involve placing the patient on the thin, firm mattress systems supplied by hyperbaric chamber manufacturers. Due to the limited space in typical hyperbaric chambers, such mattresses are usually thin and consequently firm. Some individuals or patients, however, may not be able to tolerate lying on firm mattresses typically utilized in connection with hyperbaric chambers and could be clinically compromised if transferred to such a hyperbaric chamber mattress. Further, any transfer to a different mattress could result in skin shear as well as damage to newly granulated tissues within healing ulcers.

SUMMARY OF THE INVENTION

The present invention pertains to apparatus and methods for providing a mattress pressure and temperature control system for preventing and/or for treating pressure ulcers which overcomes the shortfalls of prior art systems. The apparatus and methods of the present invention can also be utilized to allow individuals and patients with wounds such as, for example, posterior wounds, to benefit from treatments such as Hyperbaric Oxygen (HBO) Therapy without compromising the patient's overall care.

The present invention can also be utilized so as to provide a specialized sheet or material (e.g., transfer linen) and/or a mattress which can be used in transferring individuals or patients from one location to another, from one mattress to another, and/or for off-loading patients into and from a hyperbaric chamber and/or ambulance.

In a first aspect, the present invention provides a method including providing a mattress having at least two internal chambers, each chamber adapted to be independently pressurized and when pressurized, each chamber is adapted to independently support a reclined body on the mattress. The method further includes providing support for a body with a first chamber while a second chamber is depressurized at a first time, and providing support for a body with the second chamber while the first chamber is depressurized at a second time.

In a second aspect, the present invention provides an apparatus including a mattress having at least two internal chambers, each chamber adapted to be independently pressurized and when pressurized, each chamber is adapted to independently support a reclined body on the mattress. The invention further includes a pressurizing device in fluid communication with the internal chambers and adapted to pressurize each of the internal chambers at different times and to depressurize each of the internal chambers at different times.

In a third aspect, the present invention provides a system including a support, an enclosure on the support, a first chamber within the enclosure, the first chamber adapted to be pressurized and when pressurized, adapted to support a reclined body, and a second chamber within the enclosure, the second chamber adapted to be pressurized and when pressurized, adapted to support a reclined body. The system further includes a pressurizing device in fluid communication with the internal chambers and adapted to pressurize each of the internal chambers at different times and to depressurize each of the internal chambers at different times.

DESCRIPTION OF THE PREFERRED EMBODIMENTS

The apparatus and methods of the present invention provide a system for preventing and/or for treating pressure ulcers. A mattress or transfer linen includes at least two separate cavities that when pressurized, each is adapted to independently support a patient reclined on the mattress or transfer linen. In operation the cavities are alternatingly pressurized and depressurized at different times so that a patient laying on the mattress or transfer linen is supported by only one cavity at any given moment and by another one a short time thereafter. By alternating the cavity that supports the patient, prolonged application of pressure in any particular area on the patient is avoided, thus blood circulation is maintained, and the risk of pressure ulcers is greatly reduced. In some embodiments, the mattress or transfer linen may be encased in a gas permeable membrane and heated or cooled air may be supplied to the inside of the mattress or transfer linen to heat or cool the patient, respectively.

Figure 1A:
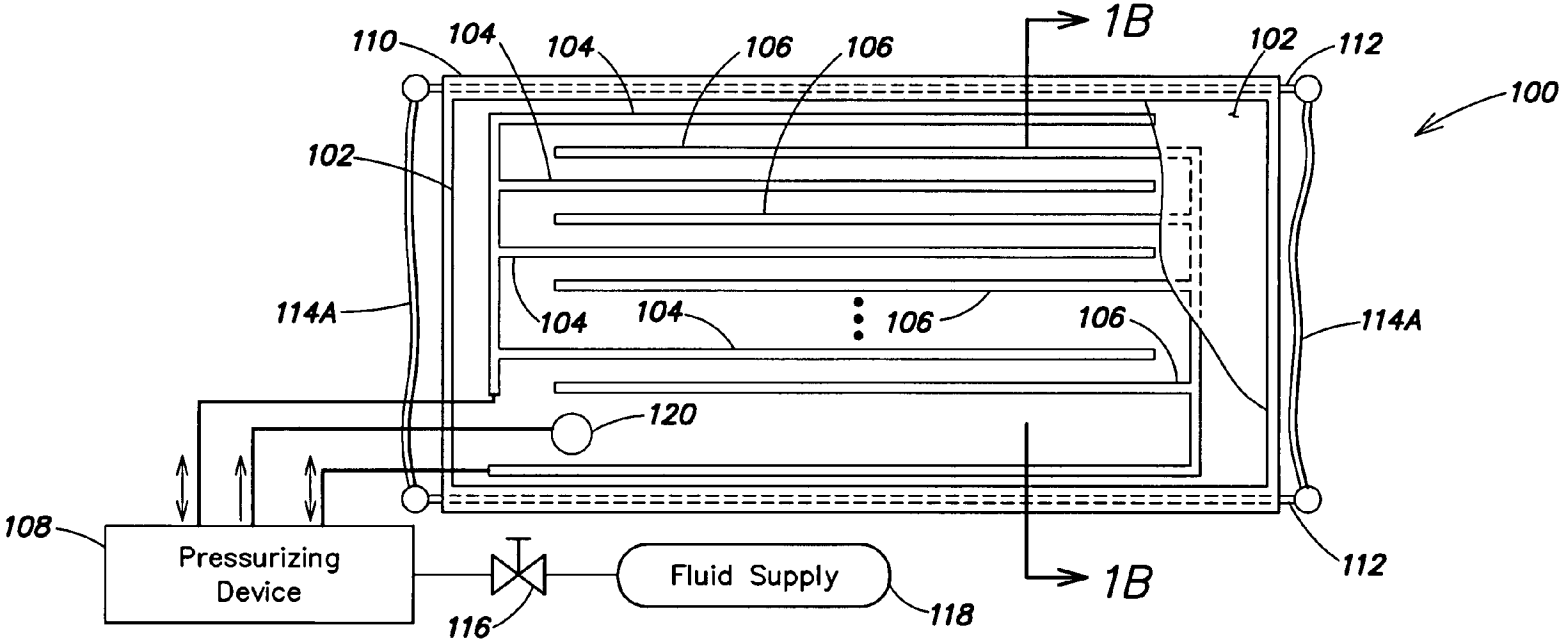
FIG. 1A illustrates a schematic, break-away top view (with a top layer of a membrane partially removed) of a first example embodiment of the apparatus of the present invention.
Figure 1B:
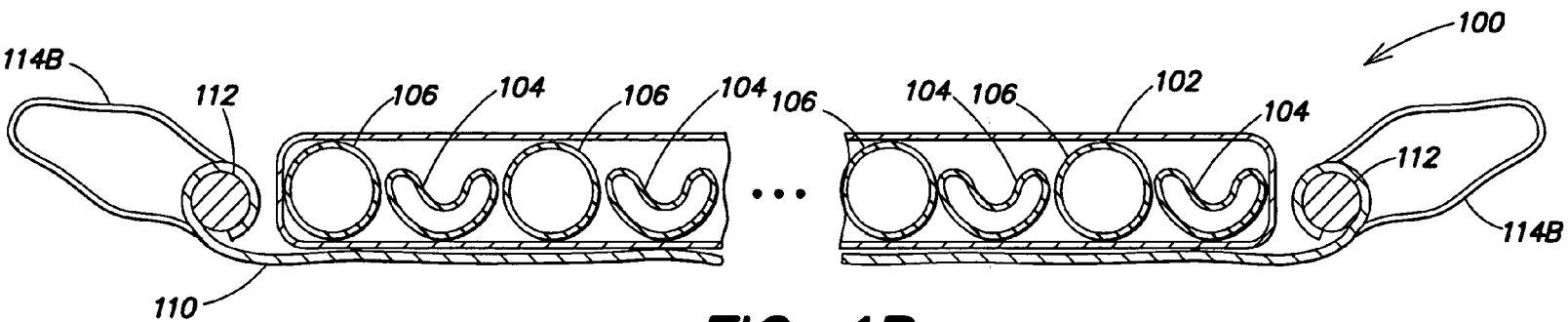
FIG. 1B illustrates an enlarged cross-sectional view taken along line 1B-1B of FIG. 1A.

FIGS. 1A and 1B illustrate a transfer linen example embodiment of the apparatus of the present invention which may be utilized with a hyperbaric chamber, e.g., a monoplace hyperbaric chamber. Conventional hyperbaric chamber mattresses typically consist of mattress materials which can include an open cell synthetic foam material which is resistant to oxidation and which is flame retardant. With reference to FIG. 1A, the inventive transfer linen apparatus, which is designated generally by the reference numeral 100, is depicted in from a schematic top view. Concurrently referring to FIG. 1B, an enlarged cross-sectional view taken along line 1B-1B of the example embodiment of FIG. 1A is presented. A membrane 102 (shown in partial break-away in FIG. 1A) encloses two independent arrays of tubes 104, 106 or cavities within the membrane 102. The tubes 104, 106 are in fluid communication with a pressurizing device 108. The membrane 102 is supported by a reinforced sheet 110 which is wrapped around or otherwise attached to support members 112 that extend the length of the transfer linen apparatus 100. Lifting straps 114A may span between the support members 112 as depicted in FIG. 1A and or lifting straps 114B may be arranged in loops extending from the support members 112 as depicted in FIG. 1B. In addition to the tubes 104, 106, the pressurizing device 108 may also be coupled to a valve 116 that gates a fluid supply 118. In addition, the pressurizing device 108 may also be coupled to an inlet 120 in the membrane 102.

The membrane 102 may be a gas permeable membrane material, such as, for example, Gortex® material, manufactured by W. L. Gore & Associates, Inc. of Newark, Del. Such a gas permeable membrane material may serve to permit the passage of air or oxygen while keeping water and bodily fluids out, thereby protecting the elements within the membrane 102. In operation, the membrane 102 may be filled via the inlet 120 by the pressurizing device 108 with a gas (e.g., air, oxygen, etc.) that may seep through the membrane 102 to evaporate/remove any moisture trapped under a patient on the transfer linen apparatus 100. In some embodiments the gas may be heated or cooled to heat or cool the patient. In some embodiments, instead of, or in addition to the inlet 120 (and a separate line from the pressurizing device 108) that provides gas to within the membrane 102, the tubes 104, 106 enclosed in the membrane 102 may include one or more relief valves (e.g., a 3 to 5 psi inline relief valve such a NewPro brand relief valve manufactured by the Swagelok Company of Solon, Ohio) that are adapted to release gas into the membrane 102 enclosure once an appropriate pressure is achieved in the tubes 104, 106. Thus, in operation, the tubes 104, 106 may be inflated to a pressure suitable to support a patient and then the pressurizing device 108 may continue to supply additional gas into the tubes 104, 106 that causes the relief valves to release gas into the membrane 102 enclosure.

The tubes 104, 106 enclosed in the membrane 102 may include silicon tubes, which, in some embodiments, may have a nominal outer diameter of approximately one inch or more. Other types of tubes, hoses, channels, cavities, or chambers made of other types of material and having different dimensions may also be used. In some embodiments, supportive cavities may be formed from elastic bladders or any practicable non-permeable material. The tubes 104, 106 may be situated in a laterally or longitudinally (as shown in FIGS. 1A and 1B) extending, alternating arrangement so that a patient reclining on the transfer linen apparatus 100 may be completely supported by either set of tubes 104, 106.

In some embodiments the tubes 104, 106 may be immediately adjacent each other while in other embodiments spacers (not shown) and/or stitching through the membrane 102 may separate the tubes 104, 106. In operation, the tubes 104, 106 may expand and/or become semi-rigid when pressurized or filled with fluid (e.g., gas or liquid) by the pressurizing device 108. The tubes 104, 106 may shrink, collapse, and/or become flaccid when depressurized by the pressurizing device 108.

For example, in the enlarged cross-sectional schematic of FIG. 1B, tubes 104 are depressurized and consequently collapsed while tubes 106 are flush with fluid from the pressurizing device 108 and thus, are fully inflated. In such a configuration, tubes 106 can support a patient reclined on the transfer linen apparatus 100. In operation, the pressurizing device 108 is used to fill tubes 104 while emptying tubes 106 to off-load the patient from tubes 106 onto tubes 104. By repeatedly off-loading the patient from one array of tubes 104 to another array of tubes 106 and then back to the original tubes 104 at a regular rate (e.g., continuously, once every twenty seconds, twice within every three minutes, etc.), the patient is not supported at the same points of contact for any extended period of time, blood is able to more easily circulate within the patient, and pressure ulcers may be avoided.

In some embodiments, the pressurizing device 108 may include a set of electronically controlled valves and/or pumps that are activated by a programmed or programmable controller and/or a timer. The valves and/or pumps may be adapted to move fluid between the different arrays of tubes 104, 106 and/or between a fluid supply 118 and reservoir/drain (not pictured in FIGS. 1A, 1B). The apparatus 100 may use either gas or liquid as the fluid. For example, in portable applications, "E" type air cylinders may be used as a gas supply and in a hospital room, conventional gas and/or liquid plumbing fixtures may be available to be used as a fluid supply.

The membrane 102 and tubes 104, 106 of the apparatus 100 may be placed on and/or situated atop a hyperbaric chamber mattress, mattress material, a gurney, an ambulance cot, a surgical table, a hospital bed, a stretcher, a floor, or the like. The apparatus 100 of FIGS. 1A and 1B serves to protect the individual or patient by keeping his or her skin dry or dryer and reduces the incidence of skin maceration and/or skin tares. The embodiment of FIGS. 1A and 1B may also be utilized in moving extremely heavy patients and in reducing the risk of developing pressure ulcers during surgical procedures, medical procedures, and/or while an individual or patient is under general anesthesia, e.g., while a patient is being operated upon, paralyzed, and/or in a coma.

As indicated above, the example embodiment of FIGS. 1A and 1B may also include lifting straps 114A, 114B attached to support members 112 and/or to the perimeter of reinforced sheet 110. Any number of lifting straps 114A, 114B may be employed, however, one strap 114B in each corner and one strap 114B in the middle of each side may provide personnel having to lift a patient sufficient flexibility. Lifting straps 114A that span between the support members 112 may be more suitable for loading/unloading crane applications such as described below with respect to FIG. 1D. In some embodiments, the lifting straps 114A, 1141B may be made of nylon webbing or any suitably strong material practicable for bearing the weight of a patient and the apparatus 100. The lifting straps 114A, 114B may be sewn or otherwise fastened to the reinforced sheet 110 or attached to/looped around the support members 112. In some embodiments, the support members 112 may be made from stainless steel or any suitably strong material practicable for bearing the weight of the patient and the apparatus 100. In some embodiments, the support members 112 may include a frame (e.g., a closed rectangular frame) that completely surrounds the apparatus 100. The reinforced sheet 110 may be made of ballistic nylon or any suitably strong material practicable for bearing the weight of the patient and the apparatus 100. The reinforced sheet 110 may be sewn or attached so as to form sleeves which can fit the support members 112 and support the apparatus 100 without creating or resulting in pressure points.

Figure 1C:
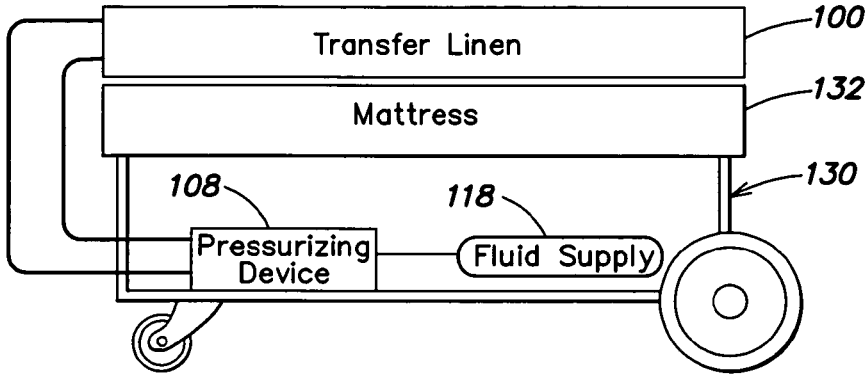
FIG. 1C illustrates a first example application of embodiments of the apparatus of the present invention.

Turning to FIG. 1C, a gurney 130 that includes a conventional gurney mattress 132 supporting the patient bearing portion of a transfer linen apparatus 100 of the present invention is depicted. The pressurizing device 108 and fluid supply 118 are supported by a lower shelf of the gurney 130. In such embodiments, the apparatus 100 may be powered by batteries (not shown). Alternatively or additionally, the apparatus 100 may include a power line (not shown) for connecting to a power outlet. In some embodiments, the conventional gurney mattress 132 may be entirely replaced by a transfer linen apparatus 100 that includes an integrated mattress within or below the membrane 102. In such embodiments, the tubes 104, 106 are disposed on top of the integrated mattress.

Figure 1D:
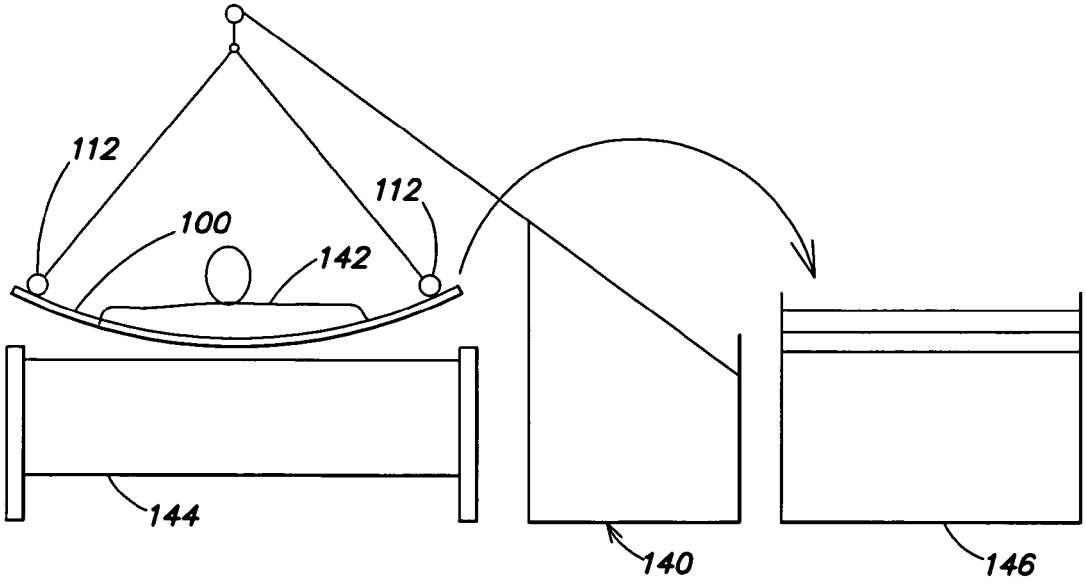
FIG. 1D illustrates a second example application of embodiments of the apparatus of the present invention.

Turning to FIG. 1D, the embodiment of FIGS. 1A and 1B may be utilized in connection with a loading/unloading crane 140 (e.g., a hydraulic lifting frame, for example, a Hoyer Patient Lift manufactured by Guardian Products Incorporated of Simi Valley, Calif.) as a transfer linen apparatus 100. A patient 142 reclined on the transfer linen apparatus 100 supported by a conventional hospital bed 144 may be lifted onto a hyperbaric chamber support 146 or gurney 130 (FIG. 1C). In some embodiments, the support members 112 (and/or lifting straps 114A, 114B, FIGS. 1A & 1B) may be attached to the loading/unloading crane 140, the transfer linen apparatus 100 and the patient may be hoisted, the loading/unloading crane 140 may be pivoted, and the transfer linen apparatus 100 and the patient may be lowered onto the hyperbaric chamber support 146.

More generally, any and/or all of the herein-described embodiments may be utilized to provide a mattress which can be inserted into a hyperbaric chamber. In such embodiments, the present invention may be utilized in order to safely transfer an individual or patient into, and from, a hyperbaric chamber. These embodiments find application in instances when, for example, an individual or patient may have a significant posterior pressure ulcer or ulcers, or flap surgeries, and may be non-ambulatory, thereby not being capable of being safely transferred from a low air loss bed or mattress, onto a stretcher for transport to a hyperbaric chamber, and thereafter into the hyperbaric chamber, without experiencing a significant risk of skin shear and/or high point pressures.

In the above embodiments, the transfer linen apparatus 100 need not be pressurized while the patient 142 is located on a low air loss mattress or bed. However, when the patient 142 is to receive a hyperbaric chamber treatment, the transfer linen apparatus 100 may be pressurized and the loading/unloading crane 140 may be attached thereto such as at or via the lifting straps 114A. Once the transfer linen apparatus 100 is inflated/pressurized, the patient 142 may be transferred onto a hyperbaric chamber support 146 or stretcher by simply lifting the transfer linen apparatus 100 as described above. Also as indicated above, this embodiment may be utilized to prevent or to reduce the incidence of skin shear, to support the patient 142, and/or to protect posterior ulcers from impacting against bed rails and/or other potential obstructions, as the patient 142 is transferred into a hyperbaric chamber.

Any of the embodiments described herein as being utilized in connection with the present invention, may also be utilized to support a patient during an actual hyperbaric chamber therapy. The apparatus 100 may include an ambient pressure sensing device (e.g., a regulator) within the hyperbaric chamber that allows the pressurizing device 108 to supply fluid (e.g., gas or liquid) to the tubes 104, 106 at an appropriate pressure to compensate for the changing pressure within the hyperbaric chamber.

Additionally, the above described loading procedure may be reversed when the patient is to be removed from a hyperbaric chamber and returned to his or her low-air loss bed. In such embodiments, a corresponding stretcher may also be equipped to contain a pressurization device or inflation control system which may be activated so as to pressurize a transfer linen apparatus 100 using a suitable air cylinder, air compressor, pump/liquid source, or other suitable fluid supply.

Figure 2A:
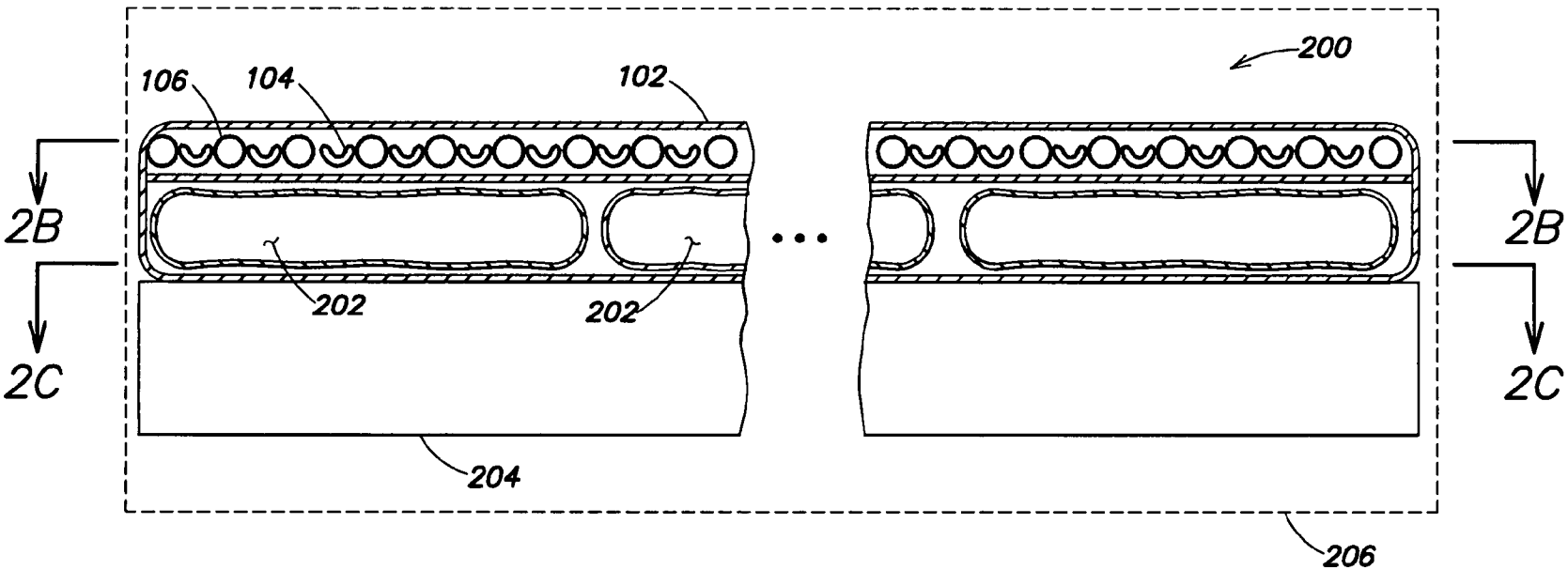
FIG. 2A illustrates a schematic, break-away end view (with an end layer of a membrane removed) of a second example embodiment of the apparatus of the present invention.
Figure 2B:
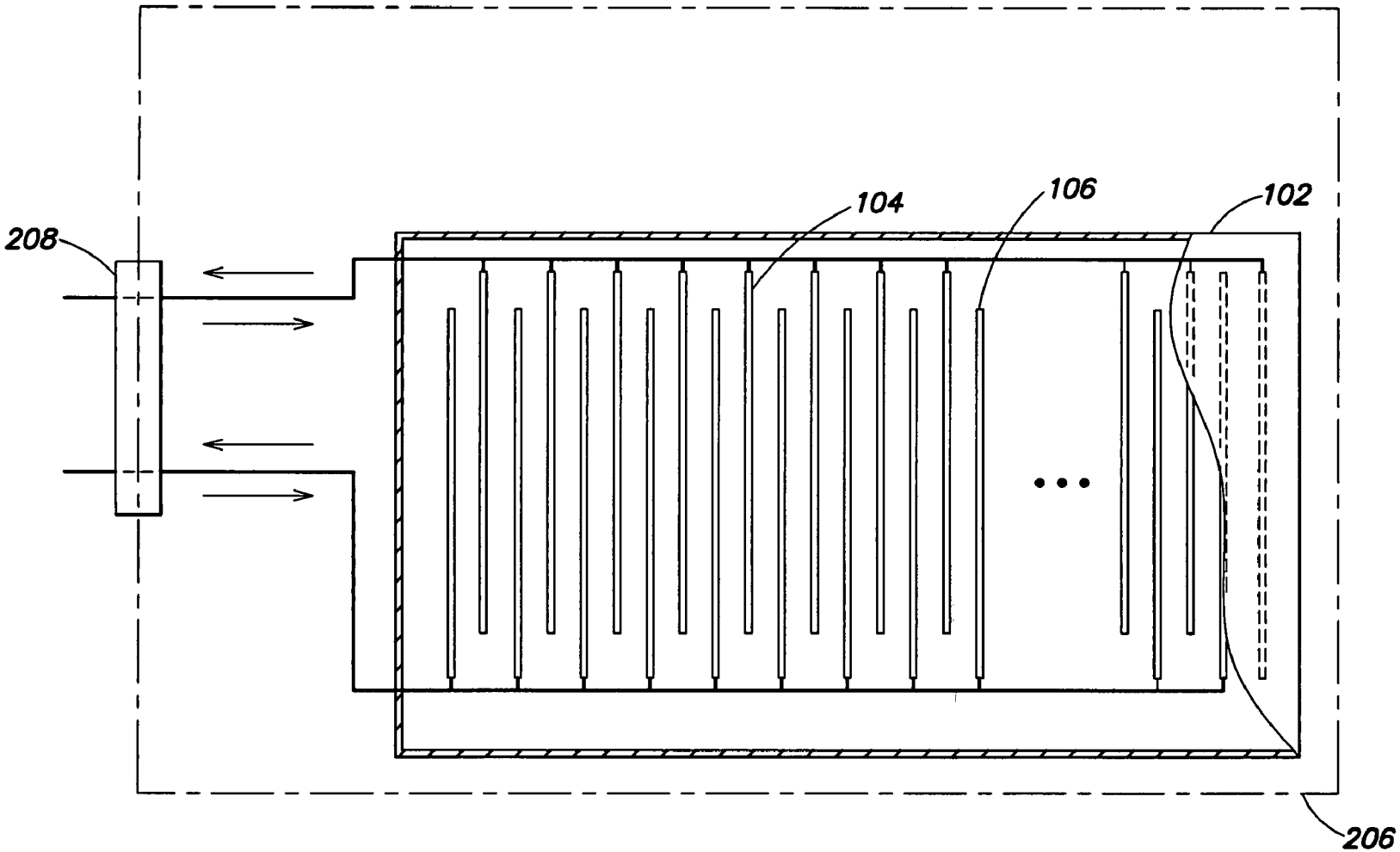
FIG. 2B illustrates a schematic, cross-sectional top view taken along line 2B-2B of FIG. 2A
Figure 2C:
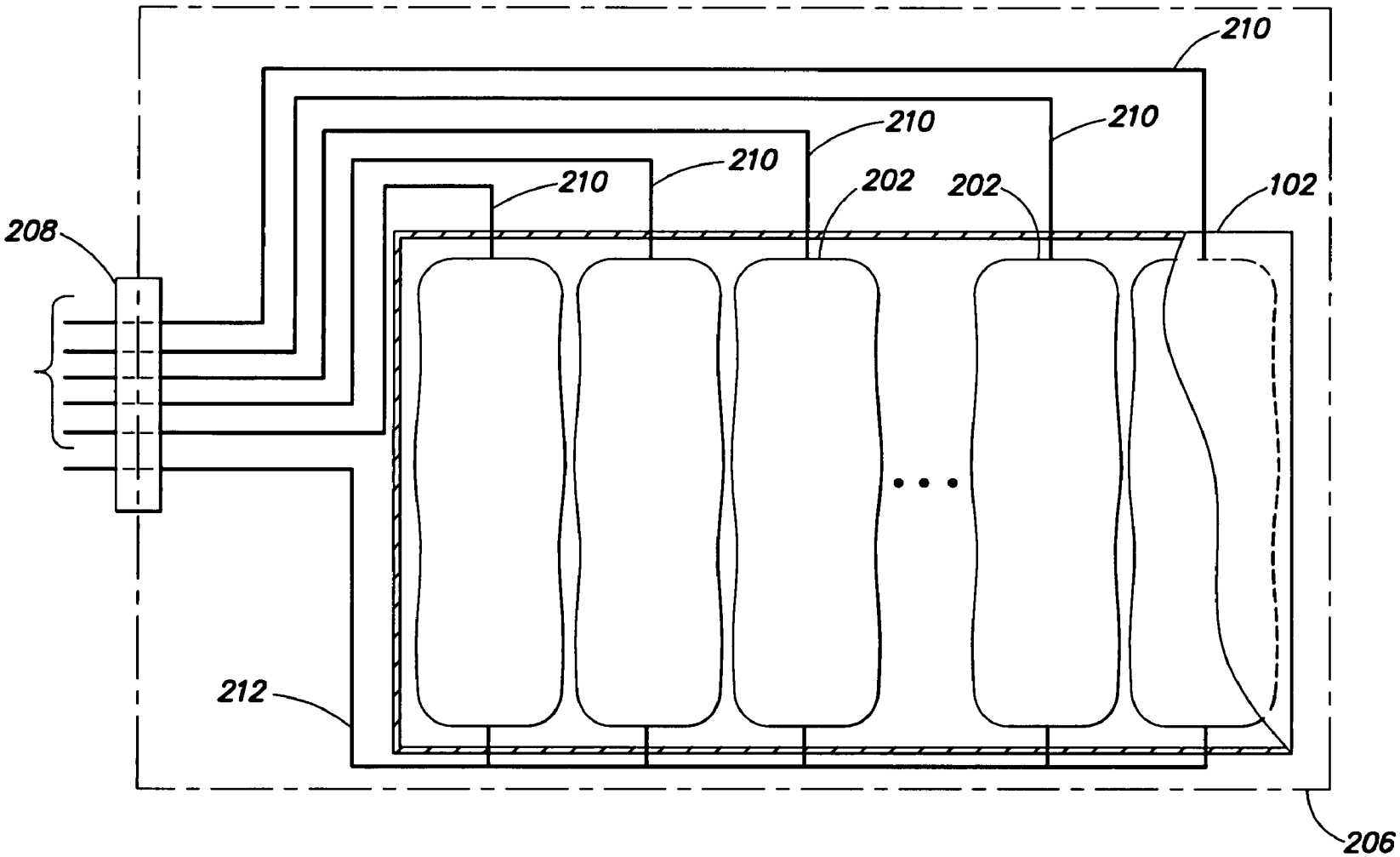
FIG. 2C illustrates a schematic, cross-sectional top view taken along line 2C-2C of FIG. 2A

The system 200 of the present invention illustrated in FIGS. 2A-C includes an integrated adjustable pillow system 202 and an integrated mattress 204. FIG. 2A illustrates a schematic, break-away end view (with an end layer of a membrane 102 removed) of a pressure off-loading mattress system 200 suitable for use in, for example, a hyperbaric chamber 206 and/or an ambulance. As with the embodiments of the present invention described above with respect to FIGS. 1A-D, this embodiment results in a patient support system that may not be substantially thicker, if at all, than a conventional mattress system but avoids the deleterious effects that the conventional mattress systems have on immobilized patients.

With reference to FIG. 2A, in addition to the tubes 104, 106 depicted therein, which can also be utilized in a pressure off-loading process, pillows 202 may be utilized to allow for an additional and/or strategically placed off-loading so as to suspend, for example, a patients heels, elevate the feet, and off-load the buttocks and/or sacral areas, and/or to elevate the head. The tubes 104, 106 and pillows 202 may be supported by a foam pad or other type of mattress 204. FIGS. 2B and 2C illustrate cross-sectional top views of the pressure off-loading mattress system 200 taken along lines 2B-2B and 2C-2C in FIG. 2A, respectively. In other words, FIG. 2B illustrates a cross-section of the tubes layer of the system 200 and FIG. 2C illustrates a cross-section of the adjustable pillow layer of the system 200.

Referring now to FIGS. 2A-C, note that in contrast to the longitudinal arrangement of tubes 104, 106 of FIGS. 1A and 1B, the tubes 104, 106 of FIGS. 2A and 2B span the system 200 laterally. In addition, rectangular-shaped inflatable pillows 202 may be utilized which may be selectively inflated by any suitable inflation system (not shown) which may be operated by an attendant outside the hyperbaric chamber 206 or by a patient in the chamber 206. Both the tubes 104, 106 and the pillows 202 may be filled and vented via lines that enter/exit the chamber via a penetrator 208. In some embodiments, the pillows 202 may each be coupled to independent supply lines 210 and may share a common vent line 212. In other embodiments, a common supply line may be coupled to all of the pillows 202 and a different, independent vent line may be coupled to each of the pillows 202. Alternatively or additionally, each pillow 202 may be supplied with a low-flow selection/relief valve (not shown) which can inflate or fill the pillow 202 slowly and allow excess pressure to vent into the atmosphere. In some embodiments, a pressure compensation circuit, which can be located outside of the hyperbaric chamber 206, may be used to maintain a desired pillow pressure over ambient chamber pressure.

Figure 3:
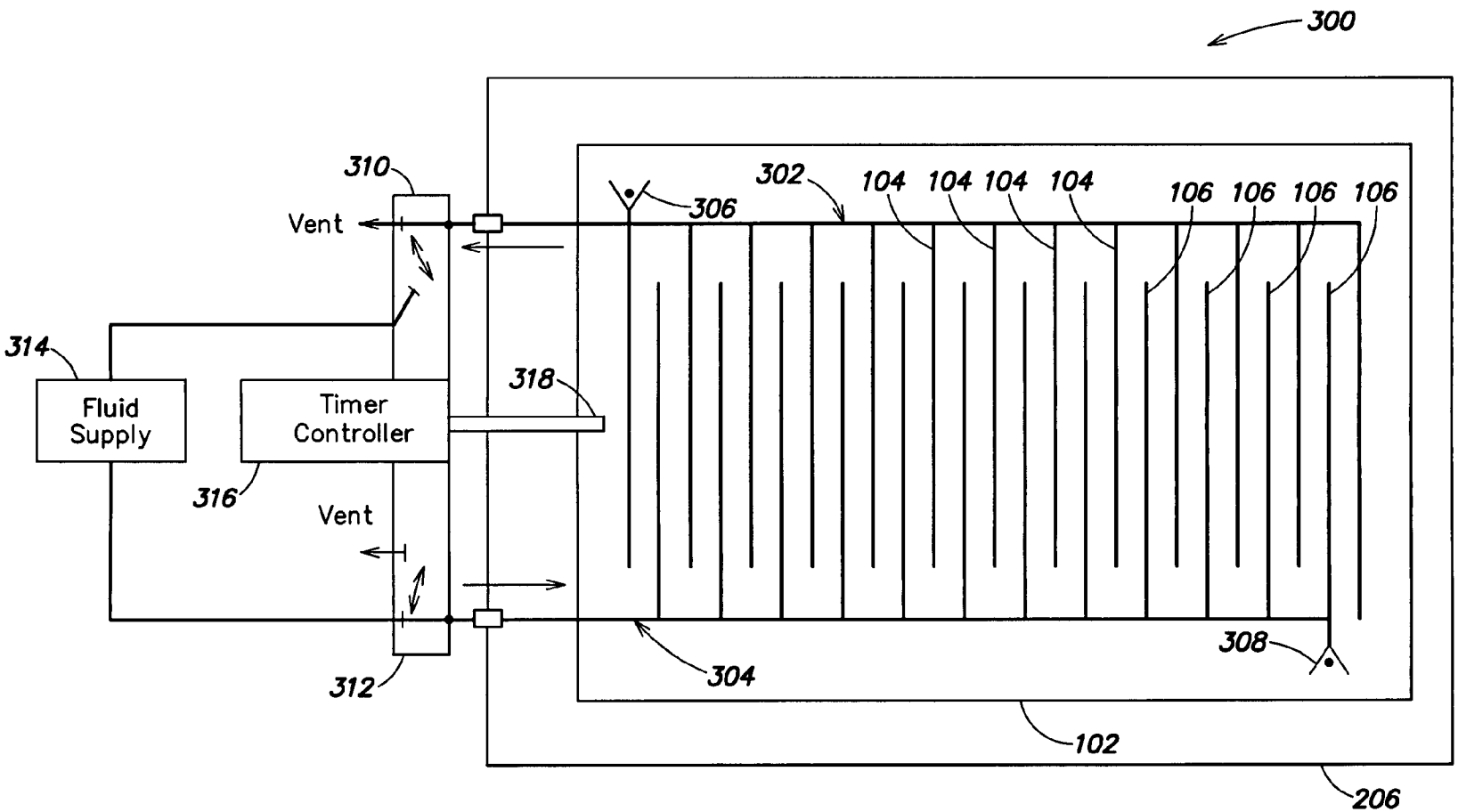
FIG. 3 illustrates a schematic representation of a third example embodiment of the apparatus of the present invention.
Figure 4:
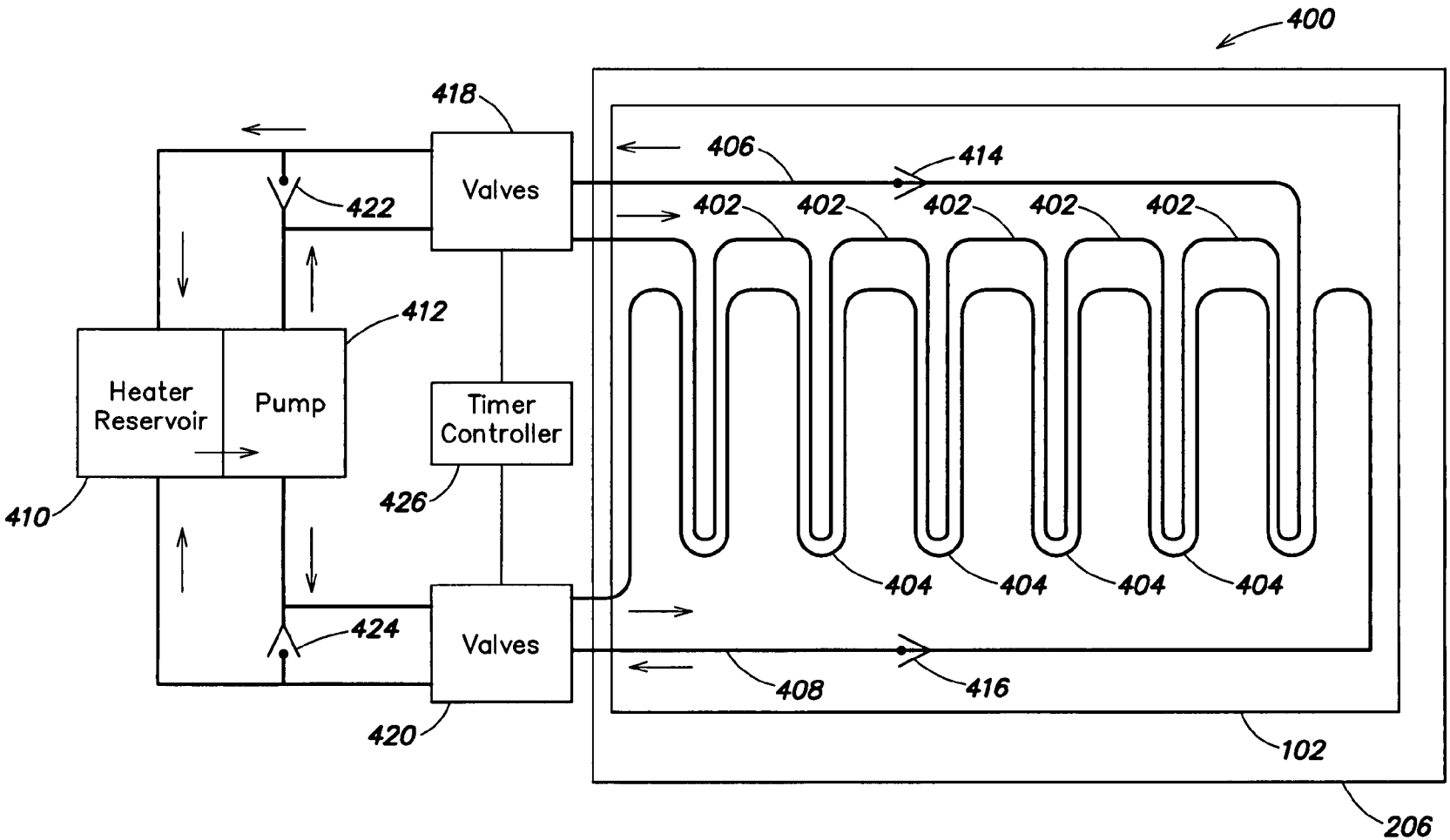
FIG. 4 illustrates a schematic representation of a fourth example embodiment of the apparatus of the present invention.

Turning now to FIGS. 3 and 4, details of the pressurization devices for two different embodiments of the present invention are illustrated. In FIG. 3, a pressure off-loading mattress system 300 that uses a push-pull pressurization arrangement is depicted. In FIG. 4, a pressure off-loading mattress system 400 that uses a circulating pressurization arrangement is depicted. Specific features of both of these embodiments will now be described in greater detail.

Referring to FIG. 3, a pressure off-loading mattress system 300 that uses a push-pull pressurization arrangement includes two (or more) arrays of tubes 104, 106 (or tubing circuits) that each fan out from a different main tube 302, 304. In some embodiments, eight or more separate/independent tube arrays or circuits may be employed. Each array of tubes 104, 106 may include a relief valve 306, 308. The arrays of tubes 104, 106 may span the mattress system 300 laterally (as depicted in FIG. 3) or longitudinally as described above. Also as with the above described embodiments, the tubes 104, 106 may generally be disposed in a parallel, coplanar, alternating or interwoven arrangement so as to both be adapted to independently support (when pressurized either pneumatically or hydraulically) a patient reclined on the mattress system 300. In operation, each array of tubes 104, 106 can be alternately pressurized with either a gas or a liquid, such as, for example, oxygen, medical air, water, water soluble fluid, gel, water mixtures, KY Jelly®, and/or Surgilube®, in order to create alternating areas of high surface area/low pressure support and no support which can be employed in order to facilitate capillary blood vessel refill in posterior tissues of a patient reclining on the mattress system 300.

The alternating pressure feature of each array of tubes 104, 106 in the mattress system 300 may be adjusted so that each circuit can be independently controlled for time and pressure about respective ambient values in order to accommodate extreme conditions and/or to accommodate various patient weight(s). In some embodiments, the apparatus of FIG. 3 may also be utilized to automatically compensate for ambient pressures or pressure changes, e.g., in a hyperbaric chamber 206, and may provide specific over-ambient pressure(s) to each separate circuit 302/104, 304/106 which may have been programmed by an operator. Valves 310 and 312 may be controlled to switch between venting fluid from the tubes 104 (as depicted by valve 310) and directing fluid from a fluid supply 314 into the tubes 106 (as depicted by valve 312). The switching of the valves 310, 312 is activated by the timer controller 316. The ambient pressure within a hyperbaric chamber 206 may determined via a sensor 318 (e.g., a regulator) that extends into the chamber 206 and is coupled to the timer controller 316.

Referring to FIG. 4, a pressure off-loading mattress system 400 that uses a circulating pressurization arrangement includes two or more tube circuits 402, 404 that each include a return 406, 408. The tube circuits 402, 404 generally lie within the same plane and are disposed in parallel serpentine, switch-back loops as shown in FIG. 4. The loops may span the mattress system 400 lateral (as depicted in FIG. 4) or longitudinally. As with the above described embodiments, the tube circuits 402, 404 are arranged so as to be adapted to independently support (when pressurized) a patient reclined on the mattress system 400. The mattress system 400 preferably uses a liquid media to pressurize/inflate the tube circuits 402, 404. For example, a temperature-controlled water or water soluble gel/water mixture may be used.

Unlike the push/pull system 300 of FIG. 3, the circulating system 400 of FIG. 4 uses separate return lines 406, 406 back to a temperature controlled fluid reservoir 410 and a positive displacement pump 412. This feature permits for a larger volume of temperature-controlled water or other liquid to be supplied from the reservoir 410 and to be circulated through the mattress 400 so as to warm and/or cool the patient by conduction. Thus, liquid flows in one direction through the tube circuits 402, 404.

During operation, fluid may be heated (or cooled) in a reservoir 410 and circulated by a positive displacement pump 412 which supplies two shuttle valves 418, 420 which alternately circulate, and fill the two tubing circuits 402, 404 with heated (or cooled) fluid. Relief valves 422, 424 open at a pre-designated pressure, such as, but not limited to, approximately 35 psig so as to provide protection for the positive displacement pump 412 in the event that the shuttle valves 418, 420 should close or that the tubing circuits 402, 404 should become occluded. When used within a hyperbaric chamber 206, tubing circuit relief valves 414, 416 may be opened at pre-designated pressures, such as, but not limited to, approximately 10 psig above the ambient sea-level or chamber pressure. The timer controller 426 alternates power to the two shuttle valves 418, 420 thereby allowing, at any given time, heated (or cooled) fluid to travel through one of the circuits 402, 404 so as to displace any cold fluid which may be present. After a preset time period has elapsed, such as approximately 20 seconds (or another time period), the controller 426 can shut-off the open shuttle valve (e.g., valve 418) and the tubing circuit (e.g., circuit 402) can be pressurized and isolated while the other shuttle valve (e.g., valve 420) is opened allowing the other tubing circuit (e.g., circuit 404) to begin to circulate fluid.

In any and/or all of the embodiments described herein, the respective embodiments can be designed to operate at atmospheric pressure or within a monoplace and/or a multiplace hyperbaric chamber environment. In any and/or all of the embodiments described herein, a respective alternating pressure off-loading control system can be located on a conventional stretcher, a chair, a recliner, a wheelchair or the like, and the individual or patient, along with the mattress, can be transferred into a hyperbaric chamber with the respective control system (e.g., pressurizing device) located outside of and/or in close proximity to the same. In some embodiments, an oxygen-driven, pneumatically designed apparatus can be utilized and can be located within a 100% oxygen chamber environment without risk of combustion or fire ignition.

In some embodiments, the pressure off-loading mattress systems of the present invention may be placed on a rail stretcher. The patient may be placed on the mattress and the alternating pressure control system may be attached to the stretcher frame and activated. Pneumatic gas power may be provided such as by an Oxygen/Medical air cylinder or other suitable device or system which can be, for example, mounted on or to the stretcher, to a wall outlet, to an electro-pneumatic air compressor and/or at any other suitable location.

When the stretcher is attached to and/or mated with hyperbaric chamber rails, the pressure off-loading mattress holding the patient may be slid into the hyperbaric chamber such as on rollers or via any other conveyance device or means. Hoses which connect the control system and the mattress may be separated or disconnected by using double-end shutoff quick disconnects or other suitable devices. Each side of the quick disconnects, for example, may then be connected to dedicated fittings which may be located on the door of the hyperbaric chamber or at another suitable location.

In some embodiments, the controller (e.g., pressurizing device) may be operated so as to continue to alternately pressurize the tubes or tube circuits of the pressure off-loading mattress through a hyperbaric chamber door penetrator or other suitable device. As the hyperbaric chamber pressurizes, the alternating pressurizing device 108 may be utilized to automatically compensate for the increasing ambient pressure which is or may be exerted on the arrays of tubes 104, 106 so as to provide a specific pressure set point and a patient lifting capability. Each tube array or tube circuit may be alternately filled with any suitable gas or fluid to a preset pressure above the ambient hyperbaric chamber pressure, and/or to any other appropriate pressure.

In some embodiments, a pre-set pressure relief valve may be located within the mattress system on each tubing circuit or array of tubes so as to allow any overpressure(s) to vent to the atmosphere in the event that the controller malfunctions or that the patient moves abruptly, thereby over-compressing a tubing circuit or array of tubes. Each volume of compression gas which is used to inflate the tubes may vent out of the control system and from a hyperbaric chamber exhaust system which is typically routed to the outside of the building that houses the hyperbaric chamber.

While the present invention has been described and illustrated in various exemplary embodiments, such descriptions are merely illustrative of the present invention and are not to be construed to be limitations thereof. In this regard, the present invention encompasses any and all modifications, variations and/or alternate embodiments with the scope of the present invention being limited only by the claims which follow.

What is claimed is:

1. A method comprising:

providing a hyperbaric environment having an elevated oxygen content, the elevated oxygen content being higher in oxygen than an average oxygen content of atmospheric air, the hyperbaric environment comprising as much as 100% oxygen, and the hyperbaric environment being free of potential combustion ignition sources;

providing a mattress completely contained in the hyperbaric environment, the mattress being removable from the hyperbaric environment, the mattress being usable outside the hyperbaric environment, the mattress having at least two internal chambers, and the mattress being free of potential combustion ignition sources, wherein each chamber is adapted to be independently pressurized relative to an ambient pressure within the hyperbaric environment and when pressurized, each chamber is adapted to independently support a reclined body on the mattress;

providing pressurization to the mattress, wherein the pressurization is driven and regulated only pneumatically;

providing support for a body with a first chamber while a second chamber is depressurized at a first time; and providing support for a body with the second chamber while the first chamber is depressurized at a second time.

2. The method of claim 1 wherein the internal chambers include sets of interwoven channels within the mattress and wherein supporting a body includes pressurizing a first set of interwoven channels with a fluid while depressurizing a second set of interwoven channels by draining a fluid from the second set of interwoven channels.

3. The method of claim 1 wherein the first chamber includes a first array of tubes that fan out from a first main tube, wherein the second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a longitudinal cross-section of the mattress.

4. The method of claim 1 wherein the first chamber includes a first array of tubes that fan out from a first main tube, wherein the second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a lateral cross-section of the mattress.

5. The method of claim 4 wherein the first main tube is coupled to a first valve that is switchable between a supply and a drain, wherein the second main tube is coupled to a second valve that is switchable between the supply and the drain, and wherein supporting a body with the first chamber includes filling the first array of tubes via the first main tube by switching the first valve to put the first main tube in fluid communication with the supply and draining the second array via the second main tube by switching the second valve to put the second main tube in fluid communication with the drain.

6. The method of claim 1 wherein the first chamber includes a first tube and the second chamber includes a second tube, and wherein the first and second tubes lie substantially within a same plane and are disposed in parallel serpentine switch-back loops.

7. The method of claim 6 wherein a first end of the first tube is coupled to a supply and a second end of the first tube is coupled to a drain, wherein a first end of the second tube is coupled to the supply and a second end of the second tube is coupled to the drain, and wherein supporting a body with the first chamber includes filling the first tube with fluid via the first end and draining fluid from the second tube via the second end.

8. An apparatus comprising:

a mattress for use completely contained in a hyperbaric environment, the mattress being removable from the hyperbaric environment, the mattress being usable outside the hyperbaric environment, the mattress having at least two internal chambers, and the mattress being free of potential combustion ignition sources, wherein each chamber is adapted to be independently pressurized relative to ambient pressure with the hyperbaric environment and when pressurized, each chamber is adapted to independently support a reclined body on the mattress; and a pressurizing device in fluid communication with the internal chambers and adapted to pressurize each of the internal chambers at different times and to depressurize each of the internal chambers at different times;

wherein the hyperbaric environment has an elevated oxygen content, the elevated oxygen content being higher in oxygen than an average oxygen content of atmospheric air, the hyperbaric environment comprising as much as 100% oxygen, and the hyperbaric environment being free of potential combustion ignition sources; and wherein the pressurizing device is driven and regulated only pneumatically.

9. The apparatus of claim 8 wherein the internal chambers each include a set of channels within the mattress that are interwoven with each other, and wherein the pressurizing device is adapted to pressurize a first set of channels with a fluid while depressurizing a second set of channels by draining a fluid from the second set of channels.

10. The apparatus of claim 8 wherein a first chamber includes a first array of tubes that fan out from a first main tube, wherein a second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a longitudinal cross-section of the mattress.

11. The apparatus of claim 8 wherein a first chamber includes a first array of tubes that fan out from a first main tube, wherein a second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a lateral cross-section of the mattress.

12. The apparatus of claim 11 further comprising a first valve and a second valve that are switchable between a supply and a drain, wherein the first main tube is coupled to the first valve, wherein the second main tube is coupled to the second valve, and wherein the pressurizing device is adapted to fill the first array of tubes via the first main tube by switching the first valve to put the first main tube in fluid communication with the supply, and wherein the pressurizing device is further adapted to drain the second array via the second main tube by switching the second valve to put the second main tube in fluid communication with the drain.

13. The apparatus of claim 8 wherein a first chamber includes a first tube and a second chamber includes a second tube, and wherein the first and second tubes lie substantially within a same plane and are disposed in parallel serpentine switch-back loops.

14. The apparatus of claim 13 wherein a first end of the first tube is coupled to a supply and a second end of the first tube is coupled to a drain, wherein a first end of the second tube is coupled to the supply and a second end of the second tube is coupled to the drain, and wherein the pressurizing device is adapted to fill the first tube with fluid via the first end, and wherein the pressurizing device is further adapted to drain fluid from the second tube via the second end.

15. The apparatus of claim 8 wherein the mattress has a temperature and wherein the mattress is adapted to control the temperature by a heated or cooled fluid in at least one of the internal chambers.

16. The apparatus of claim 8 including at least one inflatable pillow adapted to off-load a patient's heels, feet or head.

17. The apparatus of claim 8 including pneumatic valves wherein the apparatus is adapted to be used in a 100% oxygen chamber environment.

18. The apparatus of claim 8 wherein the pressurizing device is adapted to pressurize at least one of the internal chambers wherein the at least one pressurized internal chamber is adapted to provide patient lifting support.

19. The apparatus of claim 8 wherein the apparatus uses a liquid to pressurize each chamber.

20. A system comprising:

a support;

an enclosure on the support;

a hyperbaric environment, the hyperbaric environment having an elevated oxygen content, the elevated oxygen content being higher in oxygen than an average oxygen content of atmospheric air, the hyperbaric environment comprising as much as 100% oxygen, and the hyperbaric environment being free of potential combustion ignition sources; wherein the support and enclosure are free of potential combustion ignition sources, are completely contained within the hyperbaric environment, are removable from the hyperbaric environment, and are usable outside the hyperbaric environment;

a first chamber within the enclosure, the first chamber adapted to be pressurized relative to an ambient pressure within the hyperbaric environment and when pressurized, adapted to support a reclined body;

a second chamber within the enclosure, the second chamber adapted to be pressurized and when pressurized, adapted to support a reclined body;

a pressurizing device in fluid communication with the first and second chambers and adapted to pressurize each of the first and second chambers at different times and to depressurize each of the first and second chambers at different times, wherein the pressurizing device is driven and regulated only pneumatically.

21. The system of claim 20 wherein the first and second chambers each include a set of channels within the system that are interwoven with each other, and wherein the pressurizing device is adapted to pressurize a first set of channels with a fluid while depressurizing a second set of channels by draining a fluid from the second set of channels.

22. The system of claim 20 wherein the first chamber includes a first array of tubes that fan out from a first main tube, wherein the second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a longitudinal cross-section of the system.

23. The system of claim 20 wherein the first chamber includes a first array of tubes that fan out from a first main tube, wherein the second chamber includes a second array of tubes that fan out from a second main tube, and wherein the first and second arrays of tubes are disposed so that the tubes in the arrays of tubes are substantially parallel to each other, lie substantially within a same plane, and are arranged in an alternating pattern from a perspective of a lateral cross-section of the system.

24. The system of claim 23 further comprising a first valve and a second valve that are switchable between a supply and a drain, wherein the first main tube is coupled to the first valve, wherein the second main tube is coupled to the second valve, and wherein the pressurizing device is adapted to fill the first array of tubes via the first main tube by switching the first valve to put the first main tube in fluid communication with the supply, and wherein the pressurizing device is further adapted to drain the second array via the second main tube by switching the second valve to put the second main tube in fluid communication with the drain.

25. The system of claim 20 wherein the first chamber includes a first tube and the second chamber includes a second tube, and wherein the first and second tubes lie substantially within a same plane and are disposed in parallel serpentine switch-back loops.

26. The system of claim 25 wherein a first end of the first tube is coupled to a supply and a second end of the first tube is coupled to a drain, wherein a first end of the second tube is coupled to the supply and a second end of the second tube is coupled to the drain, and wherein the pressurizing device is adapted to fill the first tube with fluid via the first end, and wherein the pressurizing device is further adapted to drain fluid from the second tube via the second end.

27. The system of claim 20 wherein the support includes at least one of a bed, a gurney, a stretcher, a cot, a transfer linen, a transfer lift, an operating table, a hyperbaric chamber support, and an ambulance support.

28. The system of claim 20 wherein the support includes a reinforced sheet coupled to at least one support member.

29. The system of claim 28 further including at least one strap coupled to the at least one support member.

30. The system of claim 20 wherein the enclosure includes a gas permeable membrane and the system further includes a means for supplying air to the enclosure.

* * * * *